US005632540A

United States Patent [19]

Wilcox

[11] Patent Number: 5,632,540

[45] Date of Patent: May 27, 1997

[54] DESK WITH HIDDEN RETURN

[75] Inventor: Steven R. Wilcox, Walker, Mich.

[73] Assignee: Hekman Furniture Company, Grand Rapids, Mich.

[21] Appl. No.: 561,836

[22] Filed: Nov. 27, 1995

[51] Int. Cl.[6] ..... A47B 17/04

[52] U.S. Cl. ..... 312/197; 312/204; 312/317.3; 312/322; 108/94

[58] Field of Search ..... 312/194, 197, 312/21, 23, 25, 28, 310, 311, 314, 317.3, 322, 204; 108/64, 94

[56] References Cited

U.S. PATENT DOCUMENTS

| | | | |
|---|---|---|---|
| 330,409 | 11/1885 | Larson | 312/322 |
| 2,066,608 | 1/1937 | Bushnell | 312/204 X |
| 2,293,496 | 8/1942 | Egger | 312/322 |
| 2,566,256 | 8/1951 | Snyder | 312/314 |
| 2,928,703 | 3/1960 | Paulsen | 108/94 |
| 2,988,413 | 6/1961 | Bergen | 108/94 |
| 3,636,548 | 1/1972 | Maruzzelli | 312/282 |
| 3,781,074 | 12/1973 | Trueblood | 312/30 |

FOREIGN PATENT DOCUMENTS

| | | | |
|---|---|---|---|
| 1029304 | 6/1953 | France | 312/322 |
| 1036803 | 9/1953 | France | 312/317.3 |
| 380770 | 9/1923 | Germany | 312/197 |
| 4314405 | 11/1992 | Japan | 312/317.3 |
| 136852 | 8/1952 | Sweden | 312/317.3 |
| 152919 | 10/1920 | United Kingdom | 312/317.3 |
| 812471 | 4/1959 | United Kingdom | 312/317.3 |

*Primary Examiner*—Peter M. Cuomo
*Assistant Examiner*—James O. Hansen
*Attorney, Agent, or Firm*—Warner Norcross & Judd

[57] ABSTRACT

A desk having a pivoting, sliding hidden return mounted atop a drawer pedestal and beneath the desk top. The return is supported upon a rail and pivot mechanism which allows the return to pivot and slide between a closed position beneath the desktop and an open position perpendicular to the desktop. The return includes hinged support legs that are stored flat atop the work surface when stored and are folded down to provide support during use.

17 Claims, 7 Drawing Sheets

DESK WITH HIDDEN RETURN

BACKGROUND OF THE INVENTION

The present invention relates to furniture, and more particularly to a desk having a hidden return.

The design of a desk can have a significant impact on the efficiency and productivity of an individual. A particularly important characteristic of a desk is the mount of work surface available for use. Increased work surface reduces the mount of shuffling necessary to view multiple items. Perhaps the simplest way to increase a desk's work surface is to provide the desk with a larger desktop. However, this simple approach increases the size of the desk possibly making it too large for use in locations where space is restricted. Further, portions of a large desktop may be outside the reach of the occupant.

In an effort to balance the desire for increased work surface and minimal size, some conventional desks have been provided with one or more pullout boards (also known as writing slides or reference slides) that are slid open to increase the desk's available work surface. Pullout boards are typically located at the top of each drawer pedestal where they can be slid in and out to selectively provide additional work surface. The pullout boards are often supported on rails or runners that allow easy movement of the boards. Conventional rails and runners do not provide sufficient strength for the pullout boards to support heavy objects. Further, pullout boards have a tendency to slant downward as they are drawn out from the pedestal. Pullout boards are also limited in size roughly to the width and depth of the drawer pedestal.

SUMMARY OF THE INVENTION

The aforementioned problems are overcome by the present invention wherein a desk is provided with a hidden return that is pivotally and slidably mounted for movement between a closed position within the desk and an open exposed position perpendicular to the desktop. The return is mounted atop one of the desk pedestals and below the desktop upon a rail and pivot mechanism. The return is received within a pocket in the desk above both the pedestal and the adjacent kneehole. The return is opened by withdrawing the return a sufficient distance to provide clearance for it to pivot, and then pivoting the work surface until it is perpendicular to the desktop. The return is hidden or closed by reversing the process.

The return includes hinged support legs. When the return is closed, the support legs store flat atop the return. When the work surface is opened, the support legs fold down to support the work surface.

The present invention provides a desk having a return that is easily opened and closed to provide additional work space as desired. The return can be as long as the pedestal and kneehole are wide; and the return can be as wide as the desktop is deep. Therefore, the size of the return is not limited to the width and depth of the pedestal alone, as with pullout boards. Additionally, the hinged legs provide rigid and sturdy support.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1:
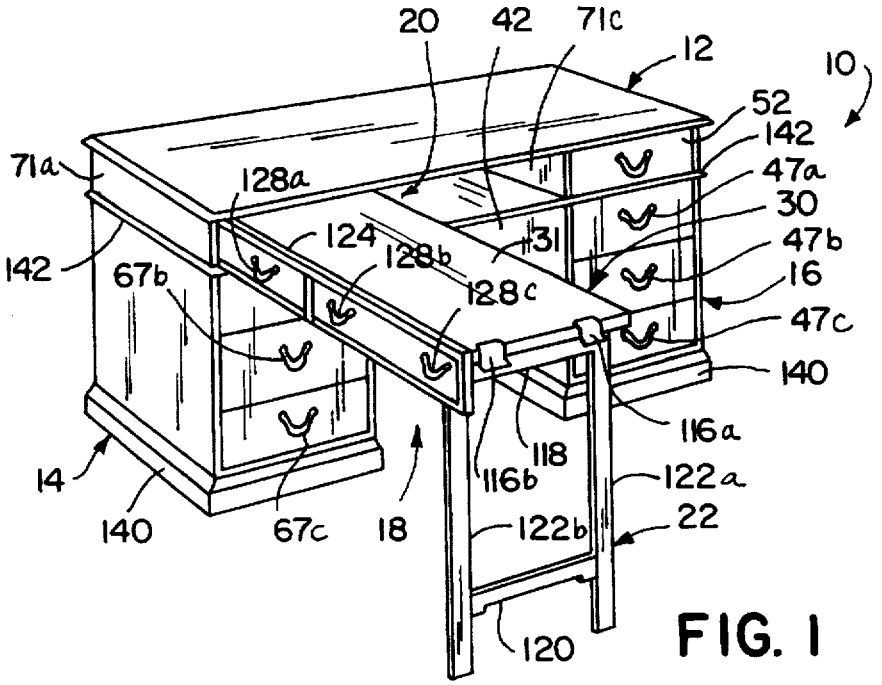
FIG. 1 is a perspective view of the desk with the return in the open position.
Figure 9:
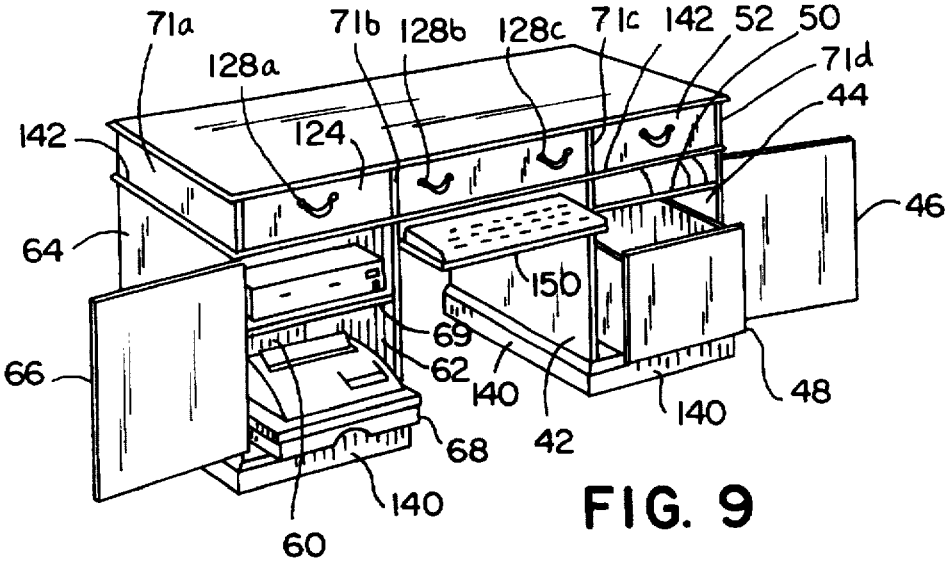
FIG. 9 is a perspective view of the desk with the return in the closed position, the keyboard tray extended, and the pedestal doors open.
Figure 2:
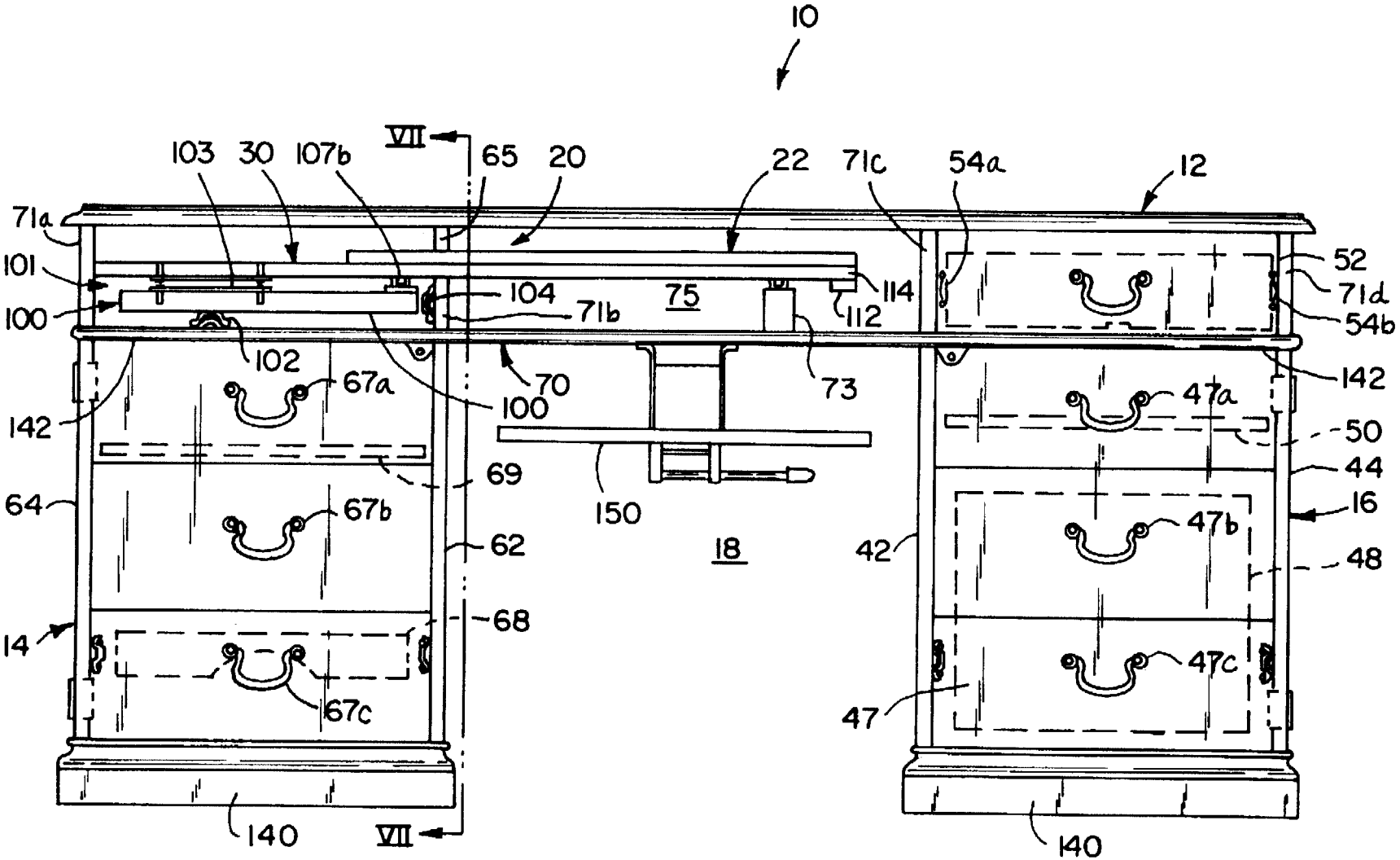
FIG. 2 is a front elevational view of the desk with the return in the closed position and with the false drawer front removed.

A desk according to a preferred embodiment of the invention is illustrated in FIG. 1 and generally designated 10. For purposes of disclosure, the present invention is described in conjunction with an executive desk. However, the present invention is equally well suited for use with other desk styles, and other pieces of furniture. For example, the return can be incorporated into a credenza, ruble, hutch, armoire, secretary, dresser, cupboard, book case, cart, work bench, cabinet, or buffet.

Figure 8:
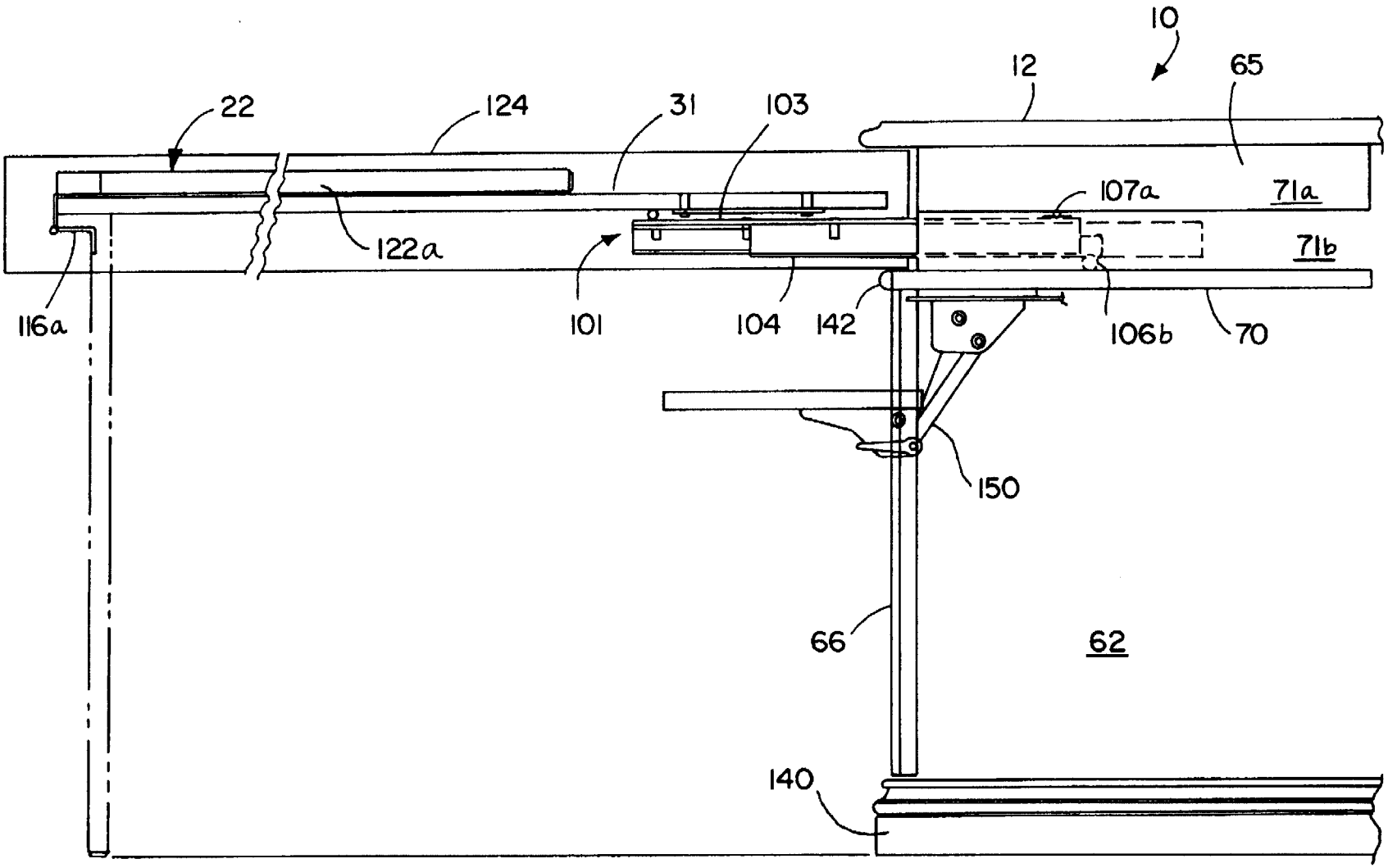
FIG. 8 is a sectional view of the desk drawn along line VIII—VIII of FIG. 4 showing the return fully withdrawn.

The desk 10 generally includes a desktop 12 supported upon a pair of pedestals 14, 16. The pedestals 14, 16 are spaced apart to define a kneehole 18 to receive the legs of an individual seated at the desk. A hidden return 30 is pivotally mounted below the desktop 12 in a cavity 20 defined above pedestal 14 and kneehole 18. The return 30 is mounted upon a return support assembly 101 which allows the return to move between a closed position within cavity 20 (see FIGS. 2, 3, 5, and 9) and an open position perpendicular to the desktop 12 (see FIGS. 1, 4, and 8). The return 30 includes a leg assembly 22 to provide support during use. The leg assembly 22 is hinged to fold flat atop the return 30 for storage.

Desk 10 is a generally conventional executive desk preferably manufactured from wood. Alternatively, the desk 10 can be manufactured from metal, plastic, press board, or other conventional materials. As noted above, the desk 10 includes a desktop 12 supported upon pedestals 14 and 16. Desktop 12 is a horizontal, rectangular, planar surface that functions as the primary work surface for the desk 10. The desktop 12 may include recessed leather panels (not illustrated) or other optional accessories. The desktop 12 can be routed, shaped, and finished as desired.

Figure 3:
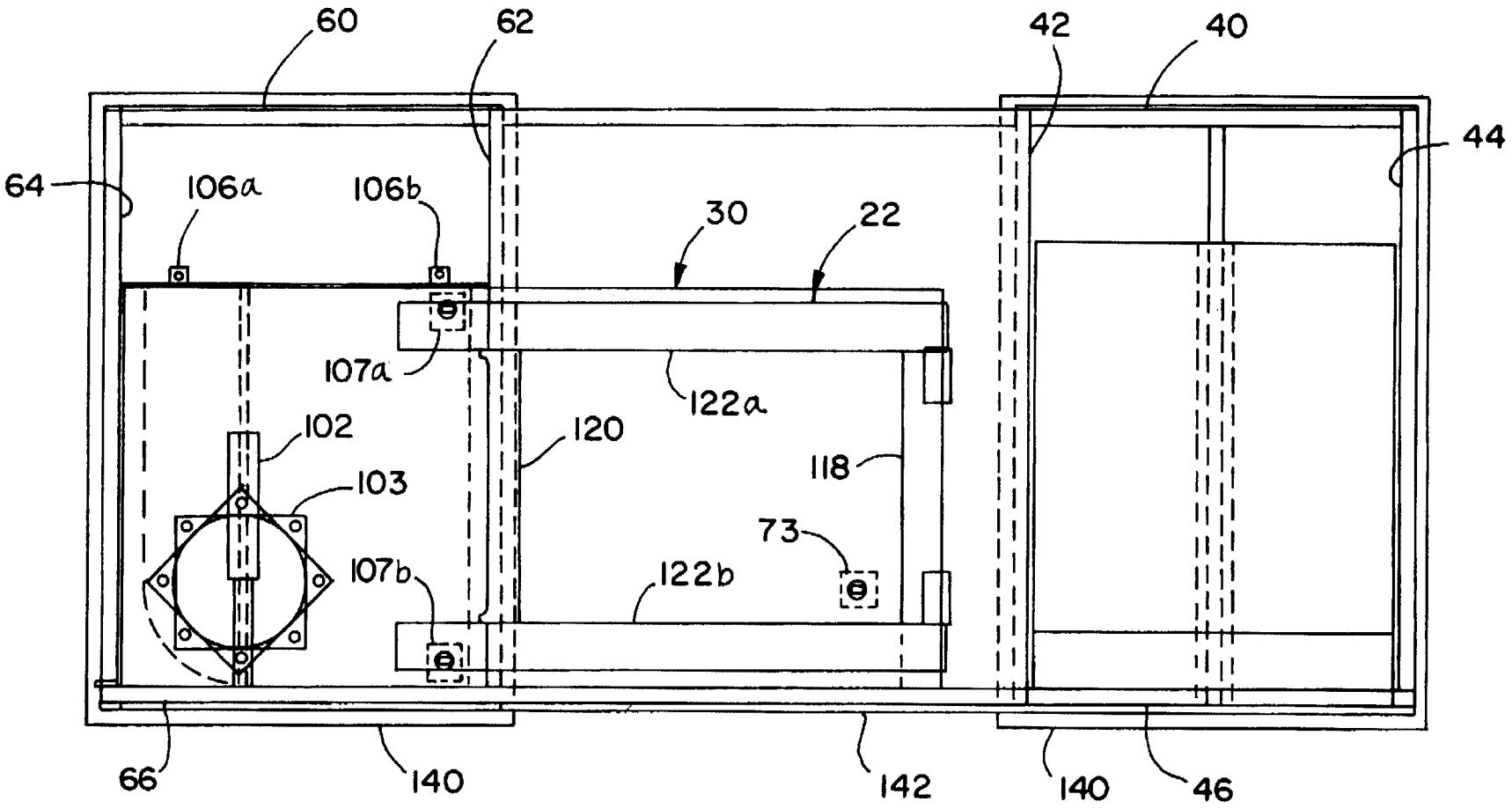
FIG. 3 is a top plan view of the desk with the return in the closed position and with the desktop removed.

Pedestal 16 is a conventional false-drawer-pedestal having a vertical back wall 40 extending between a pair of vertical side walls 42 and 44 (See FIG. 3). A door 46 is hinged to side wall 44 to cover the front of the pedestal 16. The door 46 presents a false-drawer front, and includes drawer handles 47*a–c*. Alternatively, the pedestal 16 can be fitted with conventional pullout drawers using conventional hardware. A file drawer 48 and adjustable shelf 50 are supported within pedestal 16 and are hidden behind door 46 when it is closed. The file drawer 48 and shelf 50 are conventional and are supported by conventional hardware.

The location, design and dimensions of the file drawer 48 and adjustable shelf 50 can vary as desired. Additionally, the pedestal 16 can be fitted with other conventional accessories as desired.

Pedestal 14 is somewhat similar to pedestal 16. The pedestal 14 includes a back wall 60 extending between a pair of side walls 62 and 64. A door 66 is hingedly supported on side wall 64 to cover the front of the pedestal 14. The door 66 presents a false-drawer front and includes handles 67*a–c*. A printer rack 68 and adjustable CPU shelf 69 are supported within pedestal 14 by conventional hardware. Alternatively, the pedestal 14 can be fitted with conventional drawers or other conventional accessories using conventional hardware and techniques.

A desktop assembly 69 is supported on the pedestals 14, 16. The assembly 69 includes the desktop 12 (see FIGS. 2 and 5) and houses the return 30.

The desktop assembly 69 includes a floor 70, a back wall 75, and a plurality of desktop support walls 71*a–d*. A support roller 73 extends upwardly from support 70 above kneehole 18 to engage and support the return 30. Additional support rollers can be added as necessary and/or desired. Floor 70, desktop 12, support wall 71*a*, and support wall 71*c* cooperate to define cavity 20 for receiving the hidden return when in its closed or storage position. Support wall 71*b* defines a slot 65 between floor 70 and desktop 12 to receive return 30 in the hidden position.

The desktop assembly 69 includes a conventional pullout drawer 52 above floor 70 between support walls 71*c* and 71*d*. The drawer is supported by conventional mils 54*a–b* and includes a front matching the false-drawer front of door 66.

Figure 6:
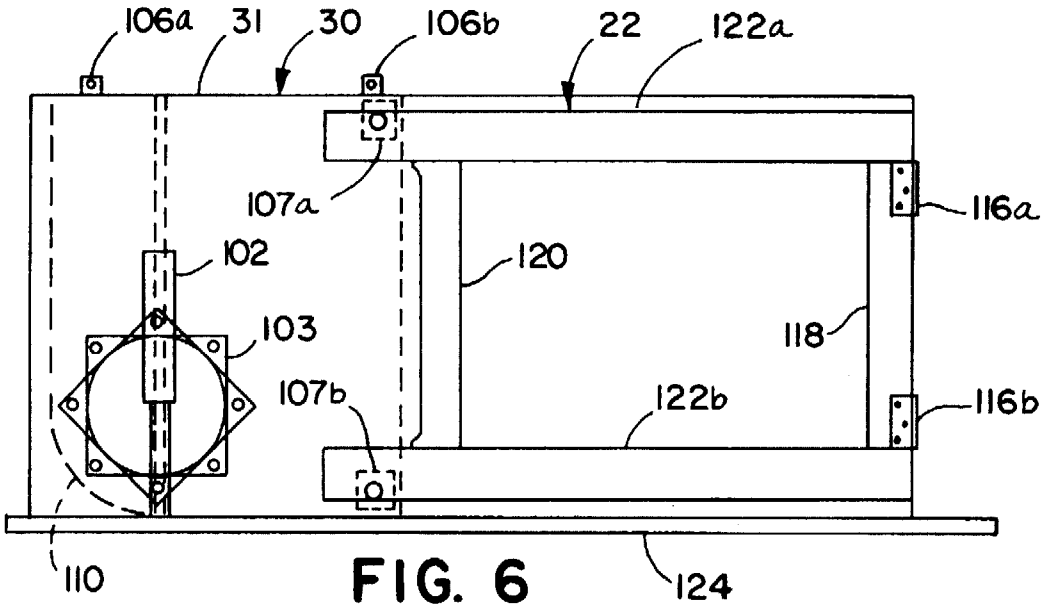
FIG. 6 is a top plan view of the return separate from the desk.

The return support assembly 101 includes a pullout platform 100 and a pivot assembly 103 mounted thereon. The pullout platform 100 is slidably mounted to floor 70 by bottom rail 102 and to support wall 71*b* by side rail 104. The two rails 102 and 104 are conventional and allow platform 100 to pull out from cavity 20. Preferably, platform 100 is generally planar and includes a corner 110 that is rounded to provide clearance for the false-drawer front to pass when return 30 pivots (See FIG. 6). A pair of rollers 106*a–b* extends downwardly from the rear of platform 100 to engage floor 70 and provide smooth, easy movement of the platform 100. A second pair of rollers 107*a–b* extends upwardly from platform 100 to engage and support return 30. Additional rollers can be added as necessary and/or desired.

The return 30 includes a return surface 31 and the leg assembly 22. Return surface 31 is a horizontal, planar, rectangular panel. The return 30 is pivotally secured atop platform 100 by pivot assembly 103 (See FIG. 6). Preferably, the return 30 is styled to match the remainder of the desk 10.

The leg assembly 22 is hingedly secured to the return by conventional L-shaped hinges 116*a–b* that wrap around the return 30 and a hinge support plate 112 extending along the bottom right edge 114 of the return surface 31. The hinges 116*a–b* are recessed to lie flush with the top of the return 30. Leg assembly 22 includes a pair of spaced-apart legs 122*a–b* that are interconnected by upper and lower braces 118 and 120, respectively. The upper brace 118 also provides an attachment surface for the hinges 116*a–b*.

A false drawer front 124 is mounted along the front edge 126 of the return 30 to conceal the return 30 when it is closed. The false drawer front 124 is a vertical, generally planar panel designed to resemble the front of two adjacent pullout drawers. Conventional drawer handles 128*a–c* are mounted to the false drawer front 124 to enhance the simulation.

The desk 10 includes conventional trim and finishing elements that enhance the appearance of the desk. For example, the pedestals 14 and 16 include conventional pedestal molding 140; and the desk 10 includes trim elements 142 surrounding floor 70. The desk 10 can include other trim and finishing elements as desired. The design and installation of these elements are generally well known to those skilled in the art, and therefore will not be described in detail.

The desk 10 includes a conventional foldaway keyboard tray 150 mounted to the undersurface of floor 70 within kneehole 18. The keyboard tray 150 complements the CPU shelf 70 and printer rack 68 to provide a desk particularly well suited for use as a computer workstation.

OPERATION

Figure 7:
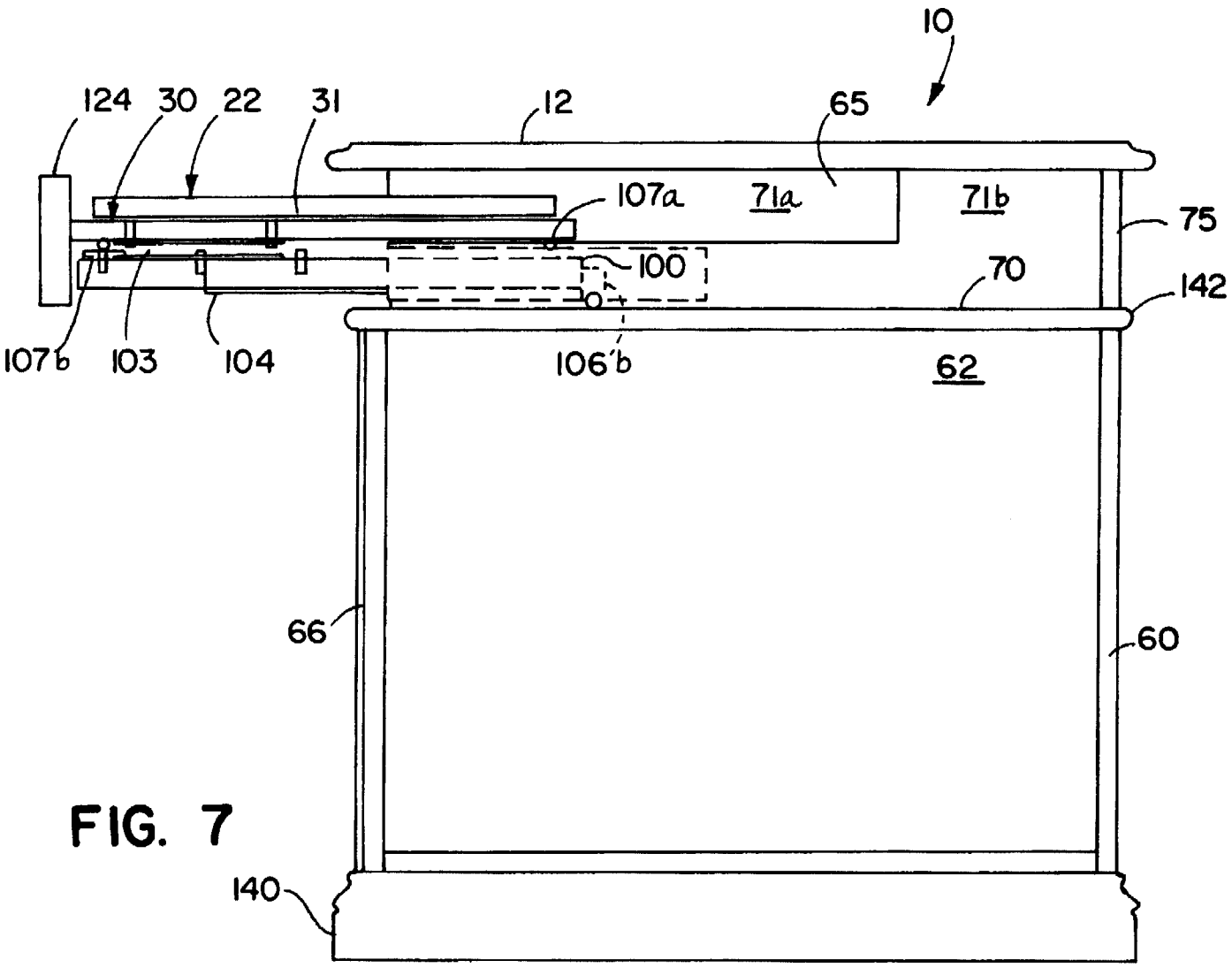
FIG. 7 is a sectional view of the desk taken along line VII—VII of FIG. 2 with the return partially withdrawn.

The return 30 is opened by withdrawing it, or sliding it out, from the desktop assembly 69 to approximately the position illustrated in FIG. 7. As the return is withdrawn, platform 100 moves on rails 102 and 104. Rollers 73 and 106*a–b* facilitate smooth and low resistance movement.

Figure 4:
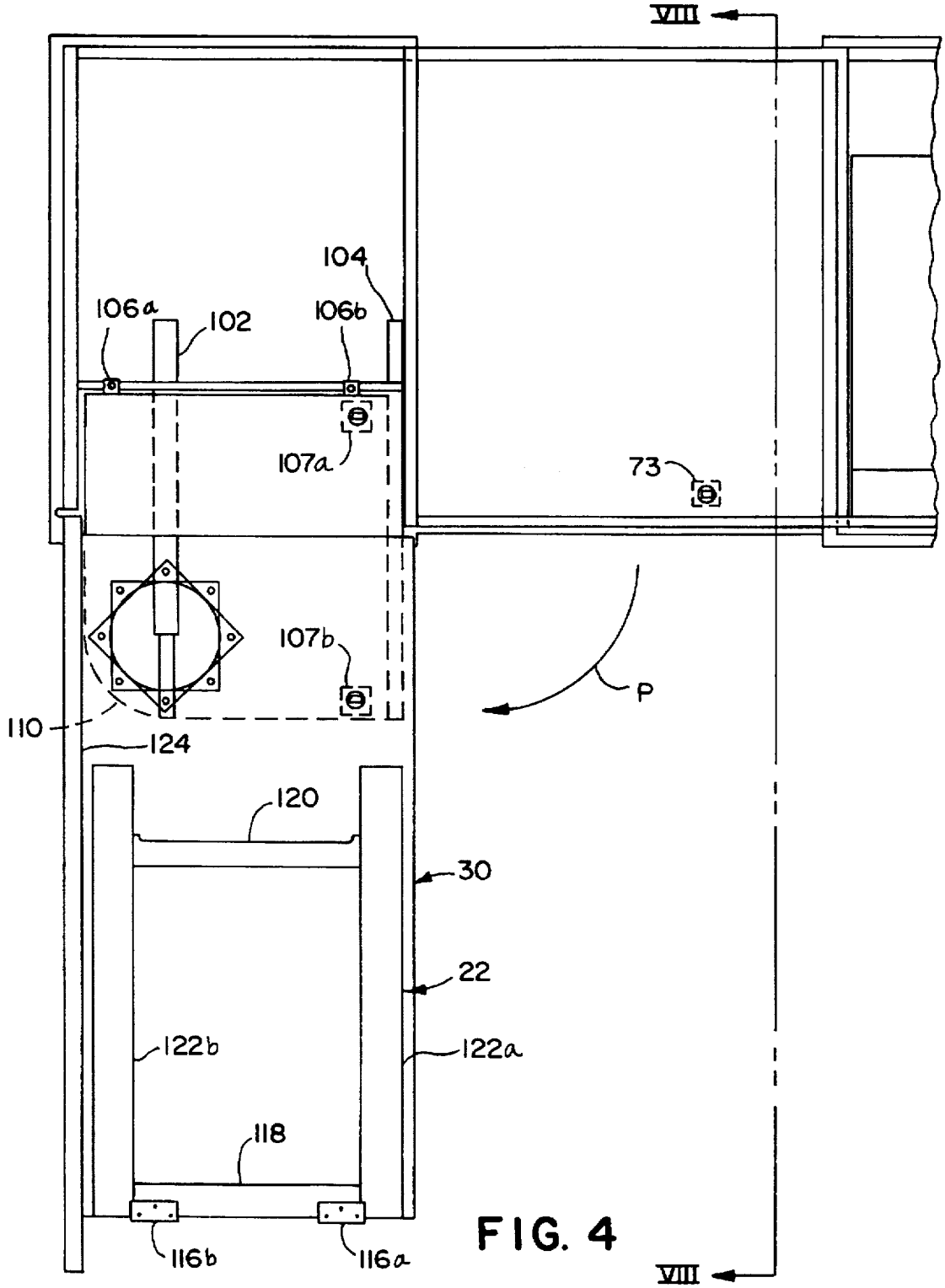
FIG. 4 is a top plan view of the desk with the return in the open position and with the desktop removed.
Figure 5:
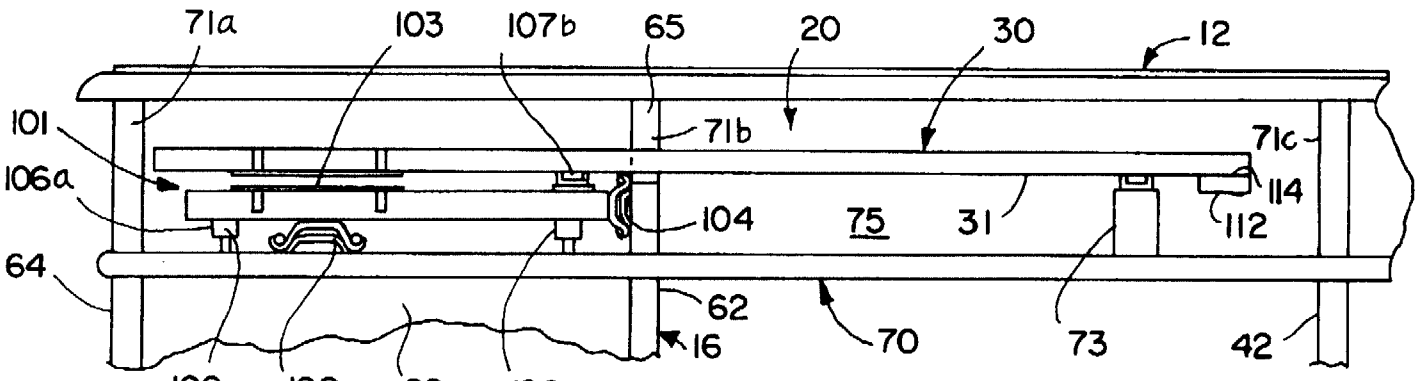
FIG. 5 is an enlarged front elevational view of the return (with the support legs removed) within the return pocket.

Next, the return 30 is pivoted outwardly approximately 90 degrees to the position shown in FIG. 4. The return 30 pivots with respect to platform 100 upon bearing assembly 103. Arrow P illustrates the direction of pivotal movement of the return. The leg assembly 22 is then folded down to engage the ground and support the return 30. The leg assembly 22 is shown in the support position in solid lines in FIG. 1 and in phantom lines in FIG. 8. The return 30 is closed by reversing this process.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents.

The embodiments of the invention in which an exclusive property or privilege is claimed are defined as follows:

1. A desk comprising:

a primary work surface;

1 pedestal supporting said primary work surface;

a secondary work surface mounted to said pedestal below said primary work surface; and a mechanism interconnecting said secondary work surface and said pedestal, said mechanism including pivoting means for allowing said secondary work surface to pivot about a vertical axis between a work position in which said secondary work surface is exposed for use and a hidden position in which said secondary work surface is hidden below said primary work surface, said mechanism further including a pullout means for allowing said secondary work surface to pull out from beneath said primary work surface while said secondary work surface is in said hidden position, said pivoting means carried by said pullout means.

2. The desk of claim 1 further comprising support legs hingedly secured to said secondary work surface for movement between a support position in which said support legs support said secondary work surface and a folded position in which said support legs are folded atop said work surface.

3. The desk of claim 2 further comprising a second pedestal, said second pedestal spaced apart from said first pedestal to define a kneehole, said secondary work surface extending above said kneehole when in said hidden position.

4. The desk of claim 3 further comprising a false drawer front mounted to said secondary work surface.

5. The desk of claim 4 wherein said mechanism includes a platform, said platform being secured to said pedestal by said pullout means and to said secondary work surface by said pivoting means.

6. A desk comprising:

a desktop;

a support spaced from said desktop to define a cavity;

a work surface; and a mechanism for interconnecting said work surface and said support, said mechanism including pivoting means for allowing said work surface to pivot about a vertical axis between a work position in which said work surface is exposed for use and a hidden position in which said work surface is hidden below said desktop within said cavity, said mechanism includes a pullout means for allowing said work surface to pull out from beneath said desktop while said work surface is in said hidden position, said pivoting means carried by said pullout means.

7. The desk of claim 6 further comprising a pedestal supporting said support and said desktop.

8. The desk of claim 7 further comprising support legs hingedly secured to said work surface for movement between a support position in which said support legs support said work surface and a folded position in which said support legs are folded atop said work surface.

9. The desk of claim 8 further comprising a second pedestal, said second pedestal spaced apart from said first pedestal to define a kneehole, said work surface extending above said kneehole when in said hidden position.

10. The desk of claim 9 further comprising a false drawer front mounted to said work surface.

11. The desk of claim 10 wherein said mechanism includes a platform, said platform being secured to said support by said pullout means and to said work surface by said pivoting means.

12. A work surface for an article of furniture having a cavity with a longitudinal extent comprising:

a generally horizontal panel having a longitudinal extent;

a generally horizontal platform interconnected with said panel by a pivoting means for allowing said panel to pivot with respect to said platform about a vertical axis such that when mounted to the article of furniture said panel is movable between a storage position in which said longitudinal extent of said panel is approximately parallel to the longitudinal extent of the cavity and a work position in which said longitudinal extent of said panel is approximately perpendicular to the longitudinal extent of the cavity; and pullout means attached to said platform for allowing said platform to mount to an article of furniture such that said platform and said panel are movable in a horizontal plane while said panel is in said storage position.

13. The work surface of claim 12 further comprising support legs hingedly secured to said panel for movement between a support position in which said support legs support said panel and a folded position in which said support legs are folded atop said panel.

14. The work surface of claim 13 further comprising a false drawer front mounted to said panel.

15. The work surface of claim 14 wherein said platform is generally rectangular, said platform including a rounded corner to provide clearance for said false drawer front when said panel is pivoted with respect to said platform.

16. An article of furniture comprising:

a body defining a cavity having a longitudinal extent;

a return having a longitudinal extent;

pivot means for pivotally mounting said return for horizontal movement between a storage position, wherein said longitudinal extent of said return is approximately parallel to said longitudinal extent of said cavity, and a use position, wherein said longitudinal extent of said return is approximately perpendicular to said longitudinal extent of said cavity; and pullout means for slidably mounting said return for linear movement into and out of said cavity while said return is in said storage position, said pivot means carried by said pullout means.

17. An article of furniture as defined in claim 16 wherein:

said body further defines an opening for said cavity; and said return includes a closure member closing said opening when said return is in said storage position.

* * * * *

UNITED STATES PATENT AND TRADEMARK OFFICE

CERTIFICATE OF CORRECTION

PATENT NO. : 5,632,540

DATED : May 27, 1997

INVENTOR(S) : Steven R. Wilcox

It is certified that error appears in the above-indentified patent and that said Letters Patent is hereby corrected as shown below:

Column 4, Claim 1, Line 42:
delete "1" and insert --a--

Signed and Sealed this

Twenty-third Day of September, 1997

*Attest:*

*Attesting Officer*

BRUCE LEHMAN

*Commissioner of Patents and Trademarks*